US011426752B2

(12) United States Patent
Lefebvre

(10) Patent No.: US 11,426,752 B2
(45) Date of Patent: Aug. 30, 2022

(54) LIQUID DISPLAY

(71) Applicant: Lee Lefebvre, Temecula, CA (US)

(72) Inventor: Lee Lefebvre, Temecula, CA (US)

( * ) Notice: Subject to any disclaimer, the term of this patent is extended or adjusted under 35 U.S.C. 154(b) by 300 days.

(21) Appl. No.: 16/381,047

(22) Filed: Apr. 11, 2019

(65) Prior Publication Data

US 2020/0324309 A1 Oct. 15, 2020

Related U.S. Application Data

(60) Provisional application No. 62/656,105, filed on Apr. 11, 2018.

(51) Int. Cl.

| | |
|---|---|
| ***G09F 13/22*** | (2006.01) |
| ***B05B 17/08*** | (2006.01) |
| ***G09F 19/12*** | (2006.01) |

(52) U.S. Cl.

CPC ..... *B05B 17/085* (2013.01); *G09F 13/22* (2013.01); *G09F 19/12* (2013.01); *G09F 2013/222* (2013.01)

(58) Field of Classification Search

CPC ..... B05B 17/085; G09F 2013/222

See application file for complete search history.

(56) References Cited

U.S. PATENT DOCUMENTS 3,644,726 A * 2/1972 Pfeuffer ..... F21S 8/00 40/406
3,964,194 A * 6/1976 Gugeler ..... F21S 6/004 40/406
4,083,631 A * 4/1978 Gugeler ..... G09F 13/24 353/120
4,085,533 A * 4/1978 Ewald ..... B44C 5/005 40/406
4,419,283 A * 12/1983 Schneider ..... G09F 13/24 252/600
5,167,993 A * 12/1992 Aoyagi ..... E06B 3/6722 40/406
5,349,771 A * 9/1994 Burnett ..... G09F 13/24 285/140.1
5,737,860 A * 4/1998 Whigham ..... B05B 17/08 40/406
5,778,576 A * 7/1998 Kaviani ..... G09F 19/02 40/406
6,187,394 B1 * 2/2001 Johnson ..... G09F 13/24 119/245
6,311,898 B1 * 11/2001 Gruff ..... B05B 17/085 239/16
6,484,425 B1 * 11/2002 Hirsch ..... B42D 3/08 281/29
6,550,168 B1 * 4/2003 Campos ..... G09F 13/24 40/406

(Continued)

*Primary Examiner* — Gary C Hoge

(74) *Attorney, Agent, or Firm* — Kirk A. Buhler; Buhler & Associates Patenting

(57) ABSTRACT

An ornamental liquid display utilizing a silicone oil as the circulating fluid. A circulator moves the fluid such that it interacts with an effect surface, creating sensory interest. The fluid may be supplemented with various dyes, fragrances, and particles, and the implementation of the display may create visual and/or auditory interests by the motion of the fluid. The display may additionally use a purifier or filter to remove outside contaminants from the fluid.

3 Claims, 4 Drawing Sheets

(56) References Cited

U.S. PATENT DOCUMENTS

| | | | | |
|---|---|---|---|---|
| 7,073,728 | B2 * | 7/2006 | Watson | B05B 17/085 239/17 |
| 7,594,350 | B2 * | 9/2009 | Yang | A47G 1/0622 40/406 |
| 7,905,426 | B1 * | 3/2011 | Greiner | A61L 9/122 239/44 |
| 8,681,423 | B1 * | 3/2014 | Gibson | G02B 6/0035 349/196 |
| 8,782,934 | B2 * | 7/2014 | Pearce | A63H 33/26 40/406 |
| 8,807,777 | B2 * | 8/2014 | Watanabe | G09F 9/30 362/101 |
| 2006/0257495 | A1 * | 11/2006 | Yang | C08F 6/04 424/490 |
| 2010/0001092 | A1 * | 1/2010 | Kloppenberg | B05B 1/36 239/20 |
| 2010/0187325 | A1 * | 7/2010 | Houstoun | B05B 17/085 239/17 |
| 2011/0099905 | A1 * | 5/2011 | Rake | B05B 17/085 49/70 |
| 2018/0214902 | A1 * | 8/2018 | Focaccia | B05B 17/085 |

* cited by examiner

LIQUID DISPLAY

CROSS REFERENCE TO RELATED APPLICATIONS

The present application claims the benefit of provisional patent application Ser. No. 62/656,105, filed Apr. 11, 2018, by the present inventor. The provisional application is incorporated by reference in its entirety.

FIELD OF INVENTION

The present invention relates to ornamental fluid displays, and more particularly to a liquid display apparatus using a silicone oil as the fluid.

BACKGROUND OF INVENTION

Fluid displays can have a significant aesthetic appeal in a variety of environments, and may be used in commercial, special event and residential applications. An ornamental fluid display may be designed for use indoors as well as outdoors, and may be fixed or mobile. It should be understood that the ornamental fluid display of the present invention may be deployed in sitting areas, lobby entrances, residences, feature walls, functional signage, logos and wall dividers. In particular, liquid displays (used interchangeably but considered to be a subset of fluid displays) can be used to create powerful visual effects. Nonetheless, deploying and maintaining an engaging liquid display may be difficult depending on the desired materials and design of the display. The present invention overcomes several of the disadvantages of previous displays, including many that use water or hydrocarbon based oils.

Fluid displays that use water have a number of disadvantages. Open air displays employing water as a circulating fluid typically have an issue with evaporation. Water that is exposed to the air, whether the water is standing or circulating, will eventually evaporate (particularly in hot and dry environments) and can leave mineral deposits. There are maintenance costs associated with replenishing the water supply and removing said mineral deposits. Standing water involves the additional concern of organic factors, as it may support the growth of mold, bacteria, and mosquito larvae (particularly in outdoor applications), possibly leading to toxicity or other direct or indirect health concerns. Water may also lead to oxidation and corrosion in various display components, placing constraints on which materials may be used. In cold environments, water can be subject to freezing which, beyond stopping the flow of fluid, can damage the display through expansion as ice forms.

Previous efforts to manage disadvantages of open air water displays have involved sealing waterfall display units, as in U.S. Pat. No. 6,311,898 issued in 2000 to Gruff.

Other previous efforts have contemplated using low and high viscosity oils (including heavy and light machine oils, typically hydrocarbon-based or unspecified) in decorative and advertising displays, as in U.S. Pat. No. 6,152,381 issued in 2000 to Hones. Among hydrocarbon-based oils, toxicity and flammability can be significant concerns. In addition, many hydrocarbons may evaporate at room temperature.

There remains a need for a decorative fluid display that safely employs a low maintenance fluid having flow performance properties similar or superior to that of water.

SUMMARY OF INVENTION

The present invention overcomes many of the drawbacks of previous displays by employing a non-toxic, non-evaporative, odor-free, non-flammable liquid in place of traditional fluids within the ornamental fluid display. The present invention improves upon the state of the art in ornamental fluid displays by employing a specific subset of fluids with properties improve upon the properties of water and many other fluids for applications in scope. In particular, the present invention looks to the group of silicone oils to achieve superior performance, safety and low-maintenance operation of ornamental fluid displays. Within this group, polydimethylsiloxane stands out for its optical properties in addition to being inert, non-evaporative, non-toxic and non-flammable. The fluid motion performance of certain low-viscosity variants adds visual interest. Combined, these properties are uncommon within the field of ornamental fluid displays and the application of silicone oil and associated techniques to the field represents a significant technical advance.

DETAILED DESCRIPTION

Some embodiments of the invention will take the form of a "water wall," with key differences. One skilled in the art of water walls will understand that a water wall may be constructed according to the teachings of U.S. Pat. No. 4,747,538 issued in 1988 to Dunn or U.S. Pat. No. 5,167,368 issued in 1992 to Nash. One key difference between the construction of a Nash or Dunn display and a display consistent with the teachings of the present invention is that at least some silicone oil will be used as the fluid within the display. Using silicone oil as the selected fluid (or primary fluid) enables safety, maintainability and fluid motion performance benefits. Once the materials have been selected, a typical construction can take place using skills expected of a person of ordinary skill in the art.

Figure 1:
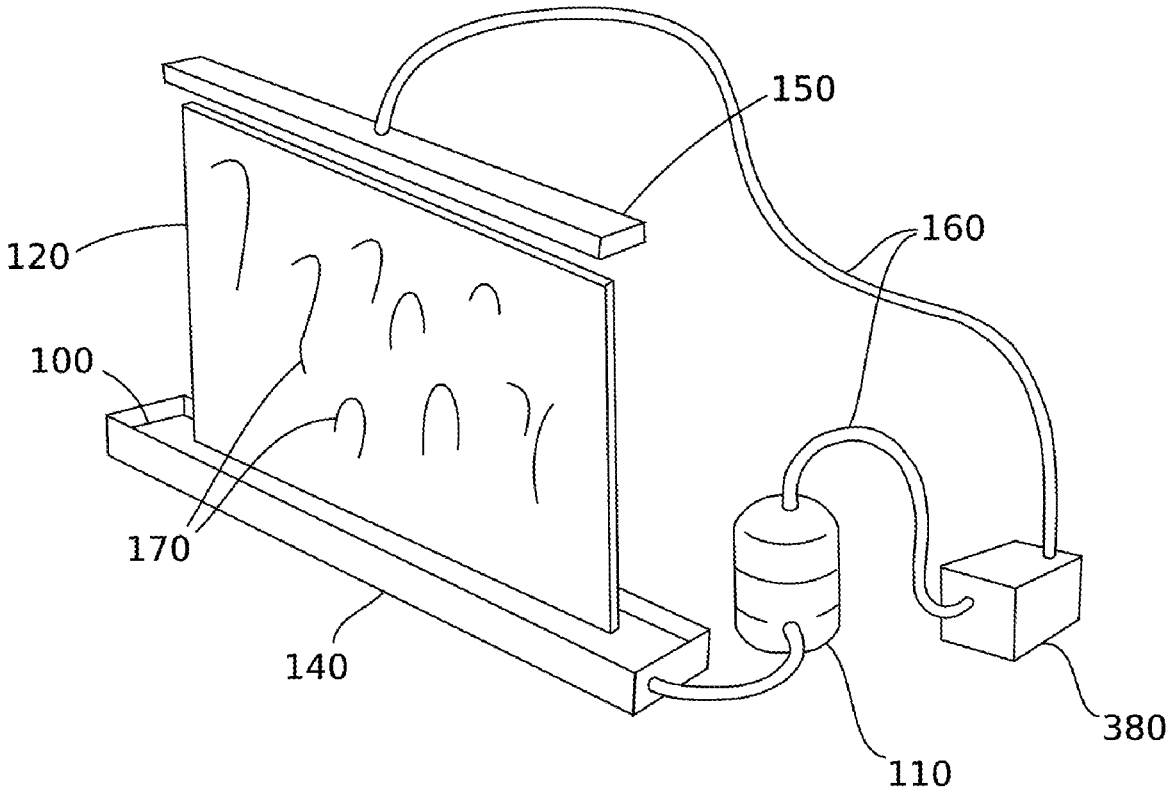
FIG. 1 is a perspective view of an embodiment of the invention

Many embodiments will employ a large planar surface oriented as a wall for fluid to flow over from top to bottom. The surface may include perturbations 130 to enhance the visual or audible effects resulting from the motion of the fluid. The surface may be made of a transparent or translucent material, such as glass, a metallic material, a natural material, such as stone, or any other material that provides a desired effect when used with the selected fluid. Some material structures that may have desired effects include mirrors, steel mesh, clear film, granite (smooth, sealed), non-porous tile, steel and copper. One embodiment is shown as an example in FIG. 1. Fluid 100 stored in the reservoir 140 flows through a filter medium 110 to remove separate unwanted debris before flowing to a pump (or circulator) 380 which provides circulation of the fluid. From the pump 380, the fluid flows through hoses or tubing 160 to an emitter or distributor 150 which deposits the fluid on the effect surface 120. In this example, gravitational forces move the fluid back to the collector/reservoir 140, where the process repeats. The fluid may optionally interact with the effect surface 120 in order to create a desired effect 170.

The filter medium 110, in the above example, serves as a purifier. In other embodiments, the fluid may be purified by neutralizing additives, for example, or by treatment with radiation or extreme temperatures.

Figure 2:
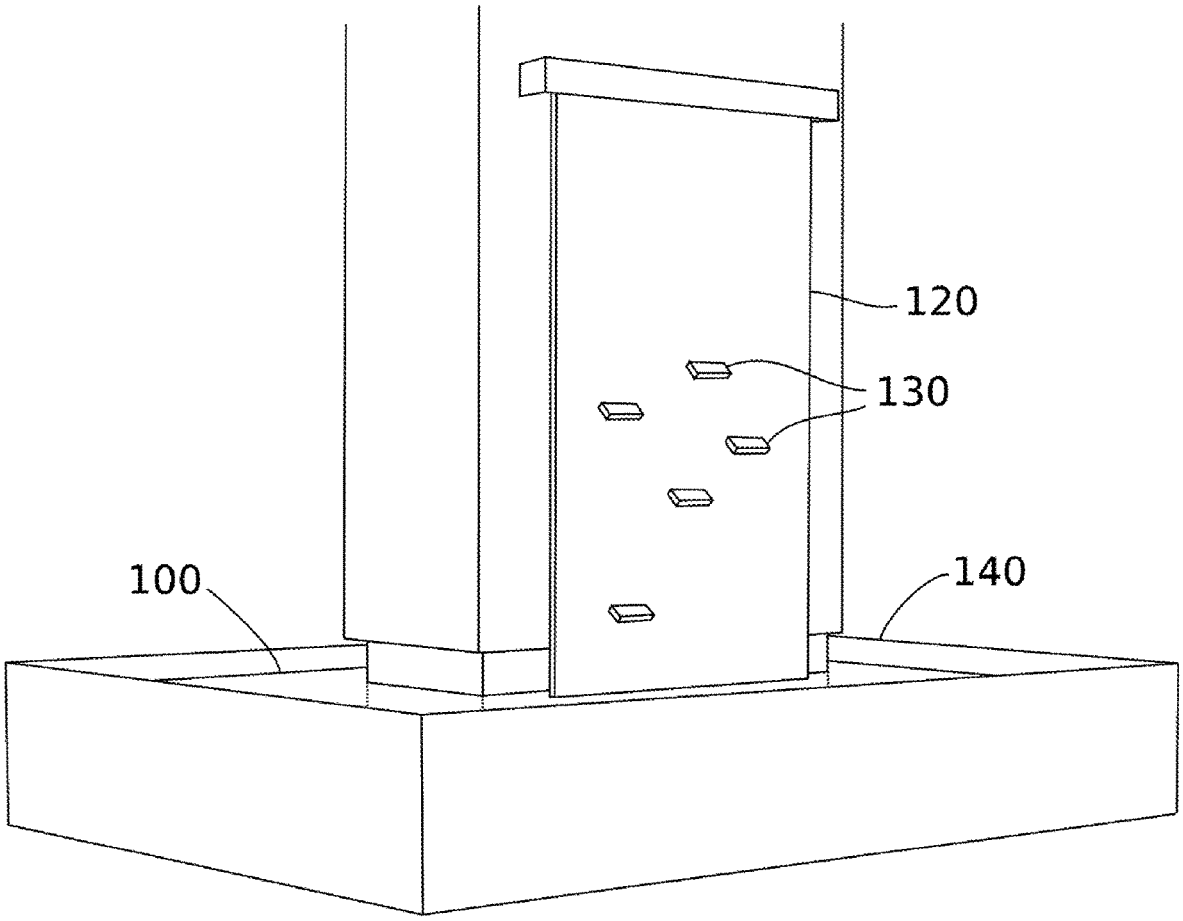
FIG. 2 is a perspective view of an example installation of an embodiment of the invention

FIG. 2 shows an example of an ornamental display as might appear in an office lobby. A vertical effect surface 120 takes the form of a planar surface of glass or plexiglass, for example. The bottom of this surface is immersed in a reservoir 140. As it is a decorative display, functional components such as the pump, filter and emitter are not visible. Perturbations 130 are formed on the effect surface 120 to make the fluid 100 generate audible and visual interest.

Figure 3:
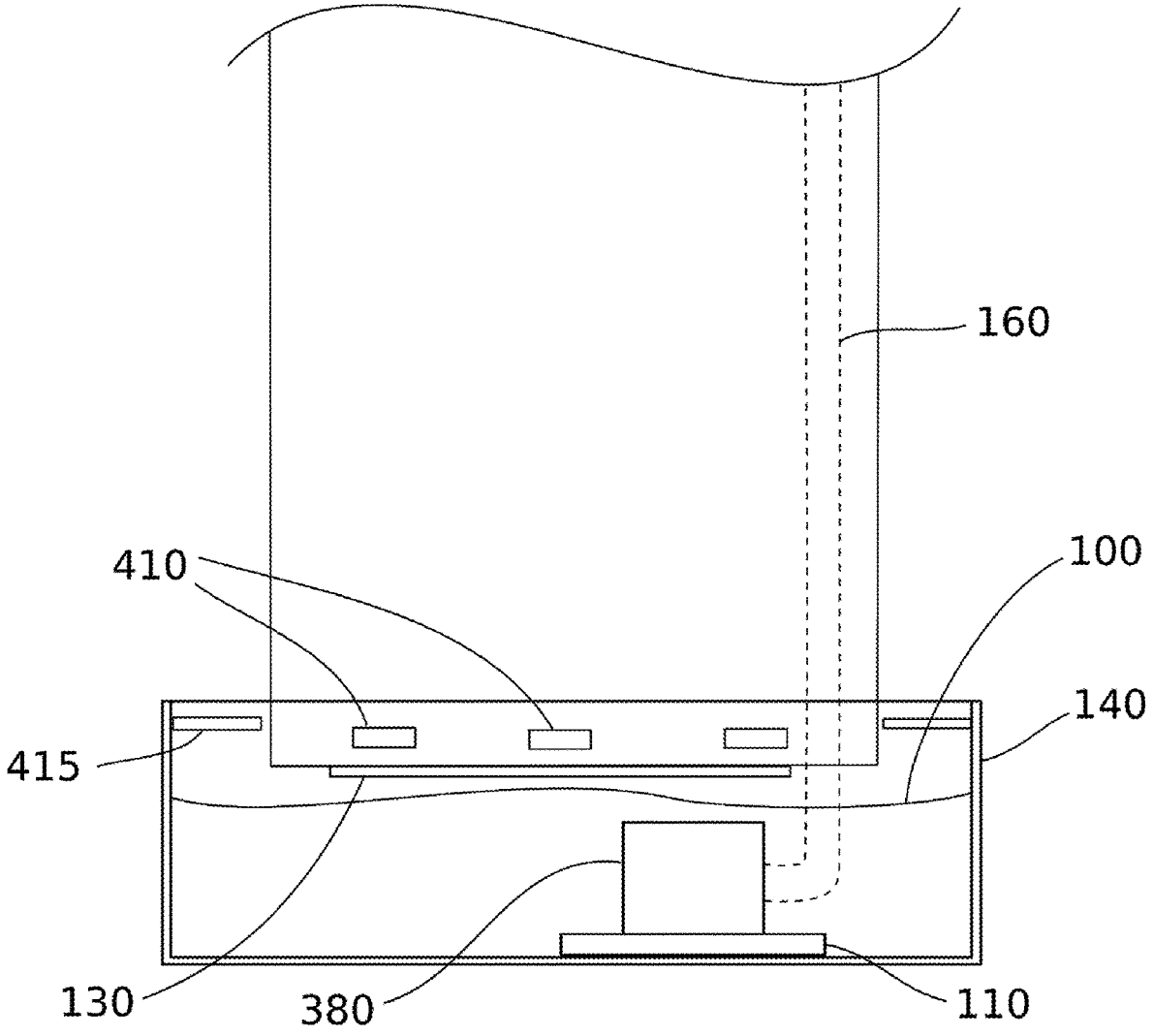
FIG. 3 is a front view of an embodiment of the invention with submerged pump

FIG. 3 shows another embodiment, where a submersible filter 110 and pump 380 is located within a sump area within the reservoir 140. In this example, an acrylic container is employed to recover and reuse the fluid from the display. Here, a spill lip 130 is used to interact with the fluid to create a desirable sound effect. A foam filter 110 cleans the fluid before the pump 380 sends it to an emitter (not shown) via a recirculating pipe 160. This example also shows that additional features of interest (rocks and lights, for example) may be used as part of the display. The example in FIG. 3 provides a removable rock tray 415 and a lighting system where the lights 410 project up from the bottom of the display.

Figure 4:
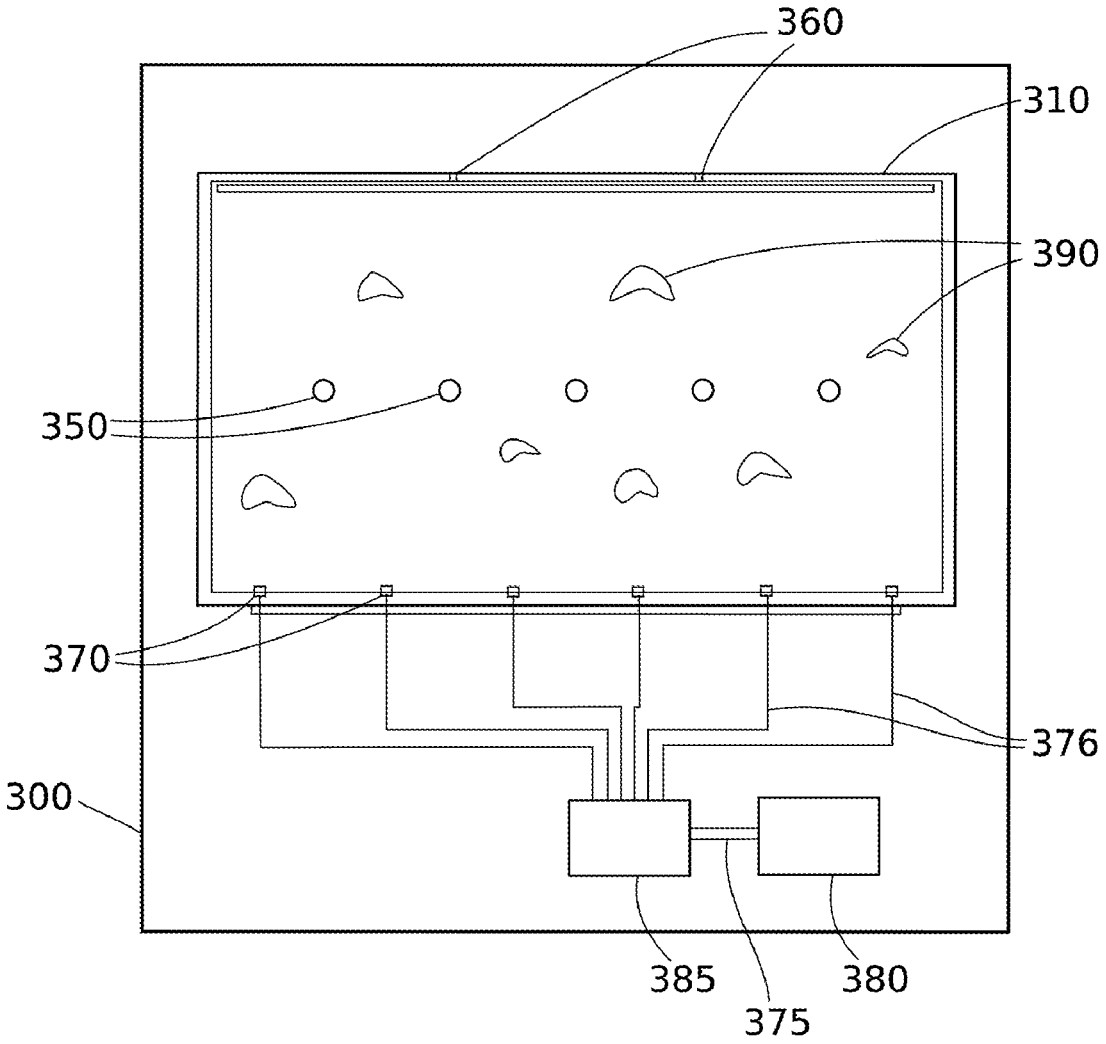
FIG. 4 is a front view of a bubble wall embodying the invention

FIG. 4 shows another embodiment, taking the form of a bubble wall. In an example bubble wall display, a container 310 holds the selected fluid. A secondary fluid, which may be another liquid or a gas such as air (as in this example), passes through the selected fluid within the container forcing the selected fluid aside as the air moves from one portion of the container to another. The air may be pumped into the bottom of the container through several air hoses 376 and nozzles 370 by an air pump 380. An air manifold 385 splits the pumped air into the plurality of air hoses. For flexibility, each nozzle may have a flow control valve. Reinforcing pucks 350 may be employed within the container 310 in order to prevent undesirable flexing of the display container. The display container 310 itself may be constructed of glass, acrylic or any material which permits the visual or other effect to be appreciated from outside the container. Depending on the desired effect, the gap between the walls of the bubble wall display (within the container) may be narrow, large or even variable. In this example, the unique air bubble effect 390 is provided by air moving up through the selected fluid. An air vent or air vents 360 may be used (at the top of the container, for example) in order to allow the air to escape, but it is understood that the bubble wall could also be formed as a closed system where the air is captured and reused once it has passed through the display.

Some embodiments of the invention may take the form of an outdoor water feature, with key differences. Such a feature may be constructed, for example, by the following steps: creating a pond shape; laying out filters and pumps (appropriate to the properties of the selected fluid) to determine flow; digging the shape to desired depths; installing a filter, underlayment (to prevent fluid leakage) and decorative stones; and filling to a desired height with fluid.

Many fluid display designs will highlight the motion of fluid as acted upon by gravitational forces, but a variety of other factors may influence or even dominate the motion. Pumps can be used to move fluid through the display. If a pump is part of the design, it may be hidden from view as necessary. In some embodiments, the pump will be submerged within the reservoir.

Lighting may be provided to illuminate the display or add to the visual effect. Many lighting sources and techniques may be used within the display. As an example, light emitting diode (LED) lighting may be desirable for applications which can benefit from low-heat generation and low power consumption. Multiple colors may be used to provide effects within the fluid and upon the adjacent surfaces.

A flow controller or shield may be used to reduce spitting, splashing and loss of fluid relating to motion. This may be necessary in certain installations to reduce the potential for a slip hazard.

In some embodiments, decorative waterfalls may be created by substituting water with an approximately 20 centistokes (cSt) silicone oil such as polydimethylsiloxane. As the viscosity of water at 72 degrees fahrenheit is 0.9504 cSt, a fluid with a kinematic viscosity substantially higher than that water can be used to enable fluid motion effects that may be less familiar to viewers. A fluid that appears to move slower, for example, may be considered more calming than a fluid that appears to move rapidly. It should be noted that although the increased viscosity of this fluid is visually appreciable, the viscosity is sufficiently comparable to water such that one may use pumps which are standard in the art.

The selected fluid may be enhanced, if desired, with metallic flakes to provide a sparkle effect. The flakes may be selected with weight, size and buoyancy within the selected fluid to enable the flakes to selectively settle or remain suspended within the fluid. As with traditional water features, the selected fluid may also be appended with dyes and/or perfumes as needed to achieve desired effects.

Where the display is in close proximity to people, it may be desirable to select components and materials that are less likely to injure or be damaged by the people. For this reason, sharp edges and toxic materials may be particularly avoided in certain applications such as shopping centers and playgrounds. Nonetheless, a properly designed installation may provide an engaging display in restaurants, lobbies and many other settings where people may be present frequently and/or in large numbers.

Although embodiments of techniques and objects have been described in language specific to features and/or methods, it is to be understood that the subject of the appended claims is not necessarily limited to the specific features or methods described. Rather, the specific features and methods are disclosed as example implementations of the present invention.

I claim:

1. An ornamental fluid display comprising: a body of fluid comprising a primary fluid; a circulator operable to effect motion in said body of fluid; an effect surface; wherein said body of fluid comprises a silicone oil; and whereby said body of fluid interacts with said effect surface providing sensory interest; further comprising: a container enclosing said body of fluid and a secondary fluid.

2. The ornamental fluid display of claim 1, wherein said container has vents operable to enable said secondary fluid to escape.

3. The ornamental fluid display of claim 1, wherein said circulator cycles said secondary fluid through said body of fluid within said container.

* * * * *